US010054382B2

(12) United States Patent
Palu et al.

(10) Patent No.: US 10,054,382 B2
(45) Date of Patent: Aug. 21, 2018

(54) NOISE SUPPRESSOR FOR FIREARM

(71) Applicant: Thunder Beast Arms Corporation, Cheyenne, WY (US)

(72) Inventors: Kurtis A. Palu, Wellington, CO (US); Michael S. Coppinger, Cheyenne, WY (US)

(73) Assignee: Thunder Beast Arms Corporation, Cheyenne, WY (US)

( * ) Notice: Subject to any disclaimer, the term of this patent is extended or adjusted under 35 U.S.C. 154(b) by 0 days.

(21) Appl. No.: 15/404,837

(22) Filed: Jan. 12, 2017

(65) Prior Publication Data

US 2017/0321984 A1 Nov. 9, 2017

Related U.S. Application Data

(60) Provisional application No. 62/278,270, filed on Jan. 13, 2016.

(51) Int. Cl.
*F41A 21/30* (2006.01)
*F41A 21/34* (2006.01)

(52) U.S. Cl.
CPC ..... *F41A 21/30* (2013.01); *F41A 21/34* (2013.01)

(58) Field of Classification Search
CPC ..... F41A 21/30; F41A 21/34
USPC ..... 89/14.4; 181/223
See application file for complete search history.

(56) References Cited

U.S. PATENT DOCUMENTS 3,786,895 A * 1/1974 Perrine ..... F01N 1/003 181/223
4,576,083 A 3/1986 Seberger, Jr.
4,907,488 A 3/1990 Seberger
5,433,133 A 7/1995 La France
6,308,609 B1 10/2001 Davies
6,374,718 B1 4/2002 Rescigno et al.
6,948,415 B2 9/2005 Matthews et al.
(Continued)

FOREIGN PATENT DOCUMENTS

WO WO 1997/007375 A2 2/1997
WO WO 2011/035111 A1 3/2011

OTHER PUBLICATIONS

U.S. Appl. No. 14/640,791; NonFinal Office Action dated Jul. 11, 2016; 21 pages.
(Continued)

*Primary Examiner* — Samir Abdosh
(74) *Attorney, Agent, or Firm* — Swanson & Bratschun, L.L.C.

(57) ABSTRACT

A noise suppressor design is provided that improves reduction of muzzle blast without increasing the size or weight of the noise suppressor. In various embodiments, a noise suppressor for a firearm might comprise a central axis and a plurality of baffles that each nests within adjacent baffles along the central axis. A first baffle and a second baffle of the plurality of baffles might each comprise a proximal end having a first/second aperture oriented along the central axis and a plurality of notches in the proximal end adjacent to the first/second aperture and aligned in a first orientation. A third baffle of the plurality of baffles might comprise a proximal end having a third aperture oriented along the central axis and a single notch in the proximal end adjacent to the third aperture and aligned in a second orientation that is 90 degrees relative to the first orientation.

18 Claims, 8 Drawing Sheets

(56) References Cited

U.S. PATENT DOCUMENTS 7,062,874 B1 6/2006 Smith
7,237,467 B1 7/2007 Melton
7,308,967 B1 * 12/2007 Hoel ..... F41A 21/30 181/223
D582,502 S 12/2008 Brittingham
D582,503 S 12/2008 Brittingham
D584,786 S 1/2009 Brittingham
D584,787 S 1/2009 Brittingham
D585,518 S 1/2009 Brittingham
D591,382 S 4/2009 Brittingham
7,587,969 B2 9/2009 Silvers
7,588,122 B2 9/2009 Brittingham
7,594,464 B2 9/2009 Dueck
7,600,606 B2 10/2009 Brittingham
7,610,710 B2 11/2009 Brittingham
7,610,992 B2 11/2009 Brittingham
7,661,349 B1 2/2010 Brittingham
7,676,976 B2 3/2010 Dueck et al.
7,743,693 B1 6/2010 Brittingham
7,789,009 B1 9/2010 Brittingham
7,832,323 B1 11/2010 Davies
7,856,914 B2 12/2010 Shults et al.
7,874,238 B2 1/2011 Silvers
7,891,282 B1 2/2011 DeGroat
7,905,171 B1 3/2011 Brittingham
7,946,069 B2 5/2011 Dueck et al.
D639,375 S 6/2011 Oliver
D642,648 S 8/2011 Oliver
D642,649 S 8/2011 Oliver
D642,650 S 8/2011 Oliver
D643,087 S 8/2011 Oliver
7,987,944 B1 * 8/2011 Brittingham ..... F41A 21/30 181/223
8,087,338 B1 * 1/2012 Hines ..... F41A 21/30 181/223
8,091,462 B2 1/2012 Dueck et al.
8,096,222 B2 1/2012 Silvers
8,100,224 B1 * 1/2012 Olson ..... F41A 21/30 181/212
8,162,100 B2 4/2012 Shults et al.
8,167,084 B1 5/2012 Moore
8,196,701 B1 6/2012 Oliver
8,201,487 B2 6/2012 Dueck et al.
8,209,895 B2 7/2012 Dueck et al.
8,272,306 B1 9/2012 Smith
8,286,750 B1 10/2012 Oliver
D677,357 S 3/2013 Dueck et al.
8,387,299 B1 3/2013 Brittingham et al.
8,397,862 B2 3/2013 Shand
8,424,441 B2 4/2013 Brittingham et al.
D682,974 S 5/2013 Honigmann
D682,975 S 5/2013 Honigmann
8,439,155 B2 5/2013 Shults et al.
D683,806 S 6/2013 Dueck
8,453,789 B1 6/2013 Honigmann et al.
8,459,405 B1 6/2013 Dueck
8,459,406 B1 6/2013 Dueck
8,474,361 B2 7/2013 Brittingham
8,490,535 B1 7/2013 Moore et al.
8,505,431 B2 8/2013 Hines
8,505,680 B2 8/2013 Dueck
8,516,941 B1 8/2013 Oliver
8,528,691 B1 9/2013 Carmichael et al.
8,539,708 B2 9/2013 Kenney et al.
8,555,765 B2 10/2013 Graham et al.
8,567,556 B2 10/2013 Dueck et al.
8,579,075 B2 * 11/2013 Brittingham ..... F41A 21/30 181/223
8,584,794 B2 11/2013 Dueck
8,714,301 B2 * 5/2014 Shults ..... F41A 21/30 181/223
8,739,922 B2 6/2014 Wirth et al.
8,763,510 B2 7/2014 Dueck et al.
8,770,084 B2 7/2014 Young
8,826,793 B2 9/2014 Oliver
8,881,862 B1 11/2014 Messer, Jr. et al.
8,939,057 B1 1/2015 Edsall
8,950,310 B2 2/2015 Storrs
8,950,546 B2 2/2015 Shults et al.
8,973,481 B2 3/2015 Dueck et al.
8,991,551 B2 * 3/2015 Latka ..... F41A 21/30 181/223
9,194,640 B2 11/2015 Wirth et al.
9,239,201 B1 1/2016 Green
9,261,317 B2 2/2016 Daniel et al.
9,291,417 B2 3/2016 James
9,316,456 B1 * 4/2016 Oliver ..... F41A 21/30
9,347,727 B1 5/2016 Cler
9,366,495 B1 6/2016 Coppinger et al.
9,400,151 B1 7/2016 Edsall
9,500,427 B1 11/2016 LaRue
9,506,710 B2 11/2016 Smith
9,513,078 B1 12/2016 Fulton et al.
9,593,899 B2 * 3/2017 Coppinger ..... F41A 21/30
9,658,019 B2 * 5/2017 Smith ..... F41A 21/325
9,719,745 B2 * 8/2017 Palu ..... F41A 21/30
2010/0126334 A1 5/2010 Shults et al.
2010/0180759 A1 7/2010 Petersen
2011/0056111 A1 * 3/2011 Brittingham ..... F41A 21/30 42/90
2011/0067950 A1 3/2011 Shults et al.
2012/0103176 A1 5/2012 Latka
2012/0272818 A1 11/2012 Dueck et al.
2012/0291614 A1 11/2012 Koumbis
2013/0180796 A1 7/2013 Dueck et al.
2013/0312592 A1 11/2013 Storrs et al.
2014/0059913 A1 3/2014 Diamond et al.
2014/0076658 A1 * 3/2014 Smith, II ..... F41A 21/30 181/223
2014/0224575 A1 8/2014 Latka
2014/0262605 A1 * 9/2014 Washburn, III ..... F41A 21/30 181/223
2014/0318887 A1 10/2014 Latka
2015/0041246 A1 * 2/2015 Coley ..... F41A 21/30 181/264
2015/0253099 A1 * 9/2015 Shults ..... F41A 21/30 181/223
2015/0285575 A1 10/2015 Sclafani
2015/0323276 A1 11/2015 Myers et al.
2015/0338183 A1 * 11/2015 Salvador ..... F41A 21/30 181/223
2016/0018178 A1 1/2016 Johansen
2016/0018179 A1 * 1/2016 Morris ..... F41A 21/30 181/223
2016/0061551 A1 3/2016 Petersen
2016/0076844 A1 3/2016 Miller, III
2016/0076845 A1 3/2016 Almazan et al.
2016/0084602 A1 3/2016 Smith
2016/0102935 A1 4/2016 Young
2016/0109205 A1 * 4/2016 Coppinger ..... F41A 21/30 89/14.4
2016/0187093 A1 * 6/2016 Barrett ..... F41A 21/28 89/14.4
2017/0038172 A1 * 2/2017 Palu ..... F41A 21/30
2017/0160034 A1 * 6/2017 Parker ..... F41A 21/30
2017/0299314 A1 * 10/2017 Palu ..... F41A 21/30
2017/0328666 A1 11/2017 Liskey et al.

OTHER PUBLICATIONS

U.S. Appl. No. 14/640,791; Notice of Allowance dated Oct. 31, 2016; 13 pages.
U.S. Appl. No. 14/615,826; Notice of Allowance dated Feb. 8, 2016; 18 pages.
U.S. Appl. No. 14/816,321; NonFinal Office Action dated Feb. 22, 2016; 17 pages.
U.S. Appl. No. 14/816,321; Final Office Action dated Jul. 11, 2016; 14 pages.
U.S. Appl. No. 14/816,321; NonFinal Office Action dated Oct. 31, 2016; 15 pages.

(56) References Cited

OTHER PUBLICATIONS

U.S. Appl. No. 14/816,321; Notice of Allowance dated Mar. 6, 2017; 13 pages.
U.S. Appl. No. 15/483,648; NonFinal Office Action dated Mar. 15, 2018; 26 pages.

* cited by examiner

NOISE SUPPRESSOR FOR FIREARM

CROSS REFERENCE TO RELATED APPLICATIONS

This application claims priority to U.S. Patent Application Ser. No. 62/278,270, filed Jan. 13, 2016 by Palu et al. and titled, "Noise Suppressor for Firearm", which is hereby incorporated by reference in its entirety.

This application may be related to the following applications (collectively, the "Related Applications"), each of which is incorporated by reference in its entirety: U.S. patent application Ser. No. 15/281,323, filed Sep. 30, 2016 by Kurtis Allen Palu and titled "Locking Mechanism for Suppressor Mount", which claims the benefit of provisional U.S. patent application No. 62/236,487, filed Oct. 2, 2015 by Kurtis Allen Palu and titled, "Suppressor Mount"; provisional U.S. patent application No. 62/322,063 filed Apr. 13, 2016 by Kurtis A. Palu and titled, "Noise Suppressor for Firearm"; provisional U.S. patent application No. 62/278,270 filed Jan. 13, 2016 by Kurtis A. Palu et al. and titled, "Noise Suppressor for Firearm"; U.S. patent application Ser. No. 14/987,984 (now U.S. Pat. No. 9,459,065), filed Jan. 5, 2016 by Kurtis A. Palu and titled, "Flash Suppressor for Firearm", which is a Division of U.S. patent application Ser. No. 14/465,060 (now U.S. Pat. No. 9,261,319) filed Aug. 21, 2014 by Kurtis A. Palu and titled, "Flash Suppressor for Firearm"; U.S. patent application Ser. No. 14/816,321 filed Aug. 3, 2015 by Kurtis A. Palu et al. and titled, "Noise Suppressor for Firearm"; U.S. patent application Ser. No. 14/640,791 filed Mar. 6, 2015 by Michael S. Coppinger et al. and titled, "Noise Suppressor for Firearm" which claims the benefit of provisional U.S. patent application Ser. No. 61/949,670 filed Mar. 7, 2014 by Michael S. Coppinger et al. and titled, "Sound Suppressor with Longitudinal Baffle"; U.S. patent application Ser. No. 14/615,826 (now U.S. Pat. No. 9,366,495) filed Feb. 6, 2015 by Michael S. Coppinger et al. and titled, "Noise Suppressor for Firearm"; and U.S. patent application Ser. No. 14/465,060 (now U.S. Pat. No. 9,261,319) filed Aug. 21, 2014 by Kurtis A. Palu and titled, "Flash Suppressor for Firearm".

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a noise suppressor design that further reduces muzzle blast without increasing the size or weight of the noise suppressor.

BACKGROUND

In order to fire a projectile, a firearm utilizes an ignited propellant to create a high-pressure pulse of hot gases behind the projectile to force the projectile down the barrel of the firearm. When the high-pressure gases exit the barrel of the firearm, they generate a loud noise, commonly referred to as a "muzzle blast." Noise suppressors are commonly used with firearms, such as rifles and handguns, to reduce muzzle blast. To reduce muzzle blast, suppressors attach to the end of the firearm barrel and allow the high-pressure gases to expand, and thereby dissipate pressure, before exiting the firearm. By allowing the pressure behind the projectile to dissipate before exiting the firearm, a firearm suppressor can significantly reduce muzzle blast.

In order to allow the high-pressure gases to expand before exiting the firearm, a noise suppressor creates a significantly larger volume than exists in the firearm barrel. Noise suppressors can create this larger volume through a series of chambers, which are often referred to as "baffles." As the projectile exits the firearm barrel, high-pressure gases expand through the series of baffles, which reduces the noise from the muzzle blast. In general, the larger the volume created through the series of baffles, the more effective the noise suppressor is in reducing muzzle blast. However, increasing the size of the baffle design also typically increases the size and/or weight of the noise suppressor, which can have negative effects on the overall performance of the noise suppressor. Moreover, baffle designs in current noise suppressors do not fully suppress the muzzle blast.

Accordingly, there is a need for a noise suppressor design that further improves the reduction of muzzle blast without increasing the size or weight of the noise suppressor.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION

Overview

Figure 1:
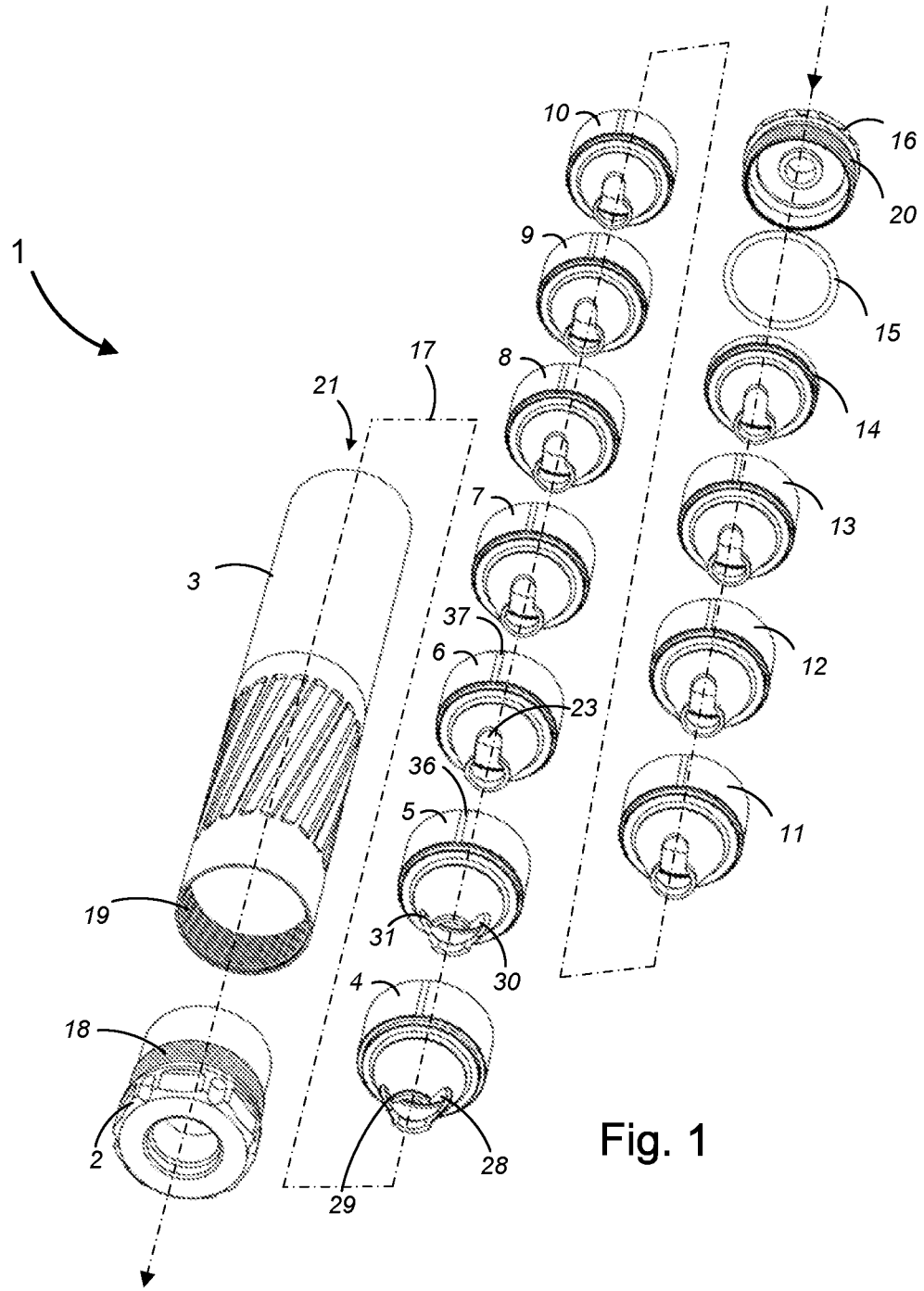
FIG. 1 shows a perspective exploded view of a noise suppressor that is an embodiment of the present invention.

Various embodiments provide for a noise suppressor that further improves the reduction of muzzle blast without increasing the size or weight of the noise suppressor.

In various embodiments, a noise suppressor for a firearm might comprise a central axis and a plurality of baffles that each nest within adjacent baffles along the central axis. Each of a first baffle and a second baffle of the plurality of baffles might comprise a proximal end having a first or second aperture oriented along the central axis and a plurality of notches in the proximal end of the first baffle adjacent to the first or second aperture and aligned in a first orientation. A third baffle of the plurality of baffles might comprise a proximal end having a third aperture oriented along the central axis and a single notch in the proximal end of the third baffle adjacent to the third aperture and aligned in a second orientation, wherein the second orientation is oriented 90 degrees with respect to the first orientation.

In some embodiments, a first cut is disposed along a portion of a distal end of the first baffle, and a second cut is disposed along a portion of the second baffle between a proximal end of the second baffle and a distal end of the second baffle. The first cut aligns with, and is adjacent to, the second cut when the second baffle is nested within the first baffle. In some cases, the first cut is disposed along a portion of an outer surface of the first baffle at the distal end of the first baffle, while the second cut is disposed along a portion of a proximal end of the outer surface of the second baffle, where the proximal end of the outer surface of the second baffle is disposed between the proximal end of the second baffle and the distal end of the second baffle, and the first cut and the second cut are cuts that are complementary with each other such that the first cut and the second cut provide alignment, and prevent rotation, of the first baffle with respect to the second baffle when the second baffle is nested within the first baffle.

In a similar manner, a third cut is disposed along a portion of a distal end of the second baffle, and a fourth cut is disposed along a portion of the third baffle between a proximal end of the third baffle and a distal end of the third baffle. The third cut aligns with, and is adjacent to, the fourth cut when the third baffle is nested within the second baffle. In some cases, the third cut is disposed along a portion of an outer surface of the second baffle at the distal end of the second baffle, while the fourth cut is disposed along a portion of a proximal end of the outer surface of the third baffle, where the proximal end of the outer surface of the third baffle is disposed between the proximal end of the third baffle and the distal end of the third baffle, and the third cut and the fourth cut are cuts that are complementary with each other such that the third cut and the fourth cut provide alignment, and prevent rotation, of the second baffle with respect to the third baffle when the third baffle is nested within the second baffle.

According to some embodiments, a cut or groove might be formed along a portion of the outer surface of each of the first through third baffles (or each of the plurality of baffles). Each cut or groove might be parallel to the central axis, and might align in series with other cuts or grooves when the baffles on which the cuts or grooves are formed are nested one within another.

The following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. In other instances, certain structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

In an aspect, a noise suppressor for a firearm might comprise a central axis, a first baffle, a second baffle, and a third baffle. The first baffle might comprise a proximal end having a first aperture oriented along the central axis; and a plurality of notches in the proximal end of the first baffle that are adjacent to the first aperture and aligned in a first orientation. The second baffle might comprise a proximal end having a second aperture oriented along the central axis; and a plurality of notches in the proximal end of the second baffle that are adjacent to the second aperture and aligned in the first orientation. The third baffle might comprise a proximal end having a third aperture oriented along the central axis; and a single notch in the proximal end of the third baffle that is adjacent to the third aperture and aligned in a second orientation, wherein the second orientation is different from the first orientation. The second baffle nests within the first baffle, while the third baffle nests within the second baffle.

In some embodiments, the second orientation might be 90 degrees with respect to the first orientation.

According to some embodiments, the first baffle might further comprise a distal end; and a first cut disposed along a portion of the distal end of the first baffle. The second baffle might further comprise a distal end; a proximal end; and a second cut disposed along a portion of the second baffle between the proximal end of the second baffle and the distal end of the second baffle. The first cut might align with, and might be adjacent to, the second cut when the second baffle is nested within the first baffle.

In some cases, the first baffle might further comprise an outer surface of the first baffle; and a third cut located along a portion of the outer surface of the first baffle, wherein the third cut is parallel to the central axis. The second baffle might further comprise an outer surface of the second baffle; and a fourth cut located along a portion of the outer surface of the second baffle, wherein the fourth cut is parallel to the central axis. The third cut and fourth cut might be aligned in series when the second baffle is nested within the first baffle. In some embodiments, the third cut is a groove and the fourth cut is also a groove.

Merely by way of example, according to some embodiments, the first cut might be disposed along a portion of the outer surface of the first baffle at the distal end of the first baffle. The second cut might be disposed along a portion of a proximal end of the outer surface of the second baffle, where the proximal end of the outer surface of the second baffle might be disposed between the proximal end of the second baffle and the distal end of the second baffle. The first cut and the second cut might be cuts that are complementary with each other, such that the first cut and the second cut provide alignment, and prevent rotation of, the first baffle with respect to the second baffle when the second baffle is nested within the first baffle.

In some embodiments, the second baffle might further comprise a fifth cut disposed along a portion of the distal end of the second baffle. The third baffle might further comprise a distal end; a proximal end; and a sixth cut disposed along a portion of the third baffle between the proximal end of the third baffle and the distal end of the third baffle. The fifth cut might align with, and might be adjacent to, the sixth cut when the third baffle is nested within the second baffle.

According to some embodiments, the first baffle might further comprise a partial conical projection having a central axis through which the first aperture is disposed. The partial conical projection of the first baffle might extend radial outward from the central axis of the partial conical projection and from the proximal end of the first baffle to a portion of the first baffle between the proximal end of the first baffle and the distal end of the first baffle. The plurality of notches might be formed within a side wall of the partial conical projection of the first baffle and adjacent to the first aperture. In a similar manner, the second baffle might further comprise a partial conical projection having a central axis through which the second aperture is disposed. The partial conical projection of the second baffle might extend radial outward from the central axis of the partial conical projection and from the proximal end of the second baffle to the portion of the second baffle between the proximal end of the second baffle and the distal end of the second baffle. The plurality of notches might be formed within a side wall of the partial conical projection of the second baffle and adjacent to the second aperture. Likewise, the third baffle might further comprise a partial conical projection having a central axis through which the third aperture is disposed. The partial conical projection of the third baffle might extend radial outward from the central axis of the partial conical projection and from the proximal end of the third baffle to the portion of the third baffle between the proximal end of the third baffle and the distal end of the third baffle. The single notch might be formed within a side wall of the partial conical projection of the third baffle and adjacent to the third aperture.

In another aspect, a noise suppressor for a firearm might comprise a central axis; a first baffle; and a second baffle. The first baffle might comprise a proximal end having a first aperture oriented along the central axis; and two notches in the proximal end of the first baffle, wherein each notch is adjacent to the first aperture and aligned in a first orientation. The second baffle might comprise a proximal end having a second aperture oriented along the central axis; and a notch in the proximal end of the second baffle adjacent to the second aperture and aligned in a second orientation, wherein the second orientation is different from the first orientation.

In some embodiments, the two notches in the proximal end of the first baffle are arranged 180 degrees with respect to each other as viewed from along the central axis. According to some embodiments, the second orientation is oriented 90 degrees with respect to the first orientation as viewed from along the central axis.

Merely by way of example, in some cases, the noise suppressor might further comprise a third baffle, the third baffle comprising a proximal end having a third aperture oriented along the central axis; and two notches in the proximal end of the third baffle, wherein each notch is adjacent to the third aperture and aligned in the first orientation. In some instances, the third baffle might nest within the first baffle, while the second baffle might nest within the third baffle.

According to some embodiments, the first baffle might further comprise a partial conical projection having a central axis through which the first aperture is disposed. The partial conical projection of the first baffle might extend radial outward from the central axis of the partial conical projection and from the proximal end of the first baffle to a portion of the first baffle between the proximal end of the first baffle and a distal end of the first baffle. The two notches might each be formed within a side wall of the partial conical projection of the first baffle and adjacent to the first aperture. Similarly, the second baffle might further comprise a partial conical projection having a central axis through which the second aperture is disposed. The partial conical projection of the second baffle might extend radial outward from the central axis of the partial conical projection and from the proximal end of the second baffle to a portion of the second baffle between the proximal end of the second baffle and a distal end of the second baffle. The notch might be formed within a side wall of the partial conical projection of the second baffle and adjacent to the second aperture. Likewise, the third baffle might further comprise a partial conical projection having a central axis through which the third aperture is disposed. The partial conical projection of the third baffle might extend radial outward from the central axis of the partial conical projection and from the proximal end of the third baffle to a portion of the third baffle between the proximal end of the third baffle and a distal end of the third baffle. The two notches might each be formed within a side wall of the partial conical projection of the third baffle and adjacent to the third aperture.

In yet another aspect, a noise suppressor for a firearm might comprise a central axis; a first baffle; and a second baffle. The first baffle might comprise a distal end; and a first cut disposed along a portion of the distal end of the first baffle. The second baffle might comprise a distal end; a proximal end; and a second cut disposed along a portion of the second baffle between the proximal end of the second baffle and the distal end of the second baffle. The second baffle might nest within the first baffle. The first cut might align with, and might be adjacent to, the second cut when the second baffle is nested within the first baffle.

According to some embodiments, the first baffle might further comprise an outer surface of the first baffle; and a third cut located along a portion of the outer surface of the first baffle, wherein the third cut is parallel to the central axis. The second baffle might further comprise an outer surface of the second baffle; and a fourth cut located along a portion of the outer surface of the second baffle, wherein the fourth cut is parallel to the central axis. The third cut and fourth cut might be aligned in series when the second baffle is nested within the first baffle. In some cases, the third cut is a groove and the fourth cut is also a groove.

In some embodiments, the first cut might be disposed along a portion of the outer surface of the first baffle at the distal end of the first baffle, while the second cut might be disposed along a portion of a proximal end of the outer surface of the second baffle, where the proximal end of the outer surface of the second baffle might be disposed between the proximal end of the second baffle and the distal end of the second baffle, and the first cut and the second cut are cuts that are complementary with each other, such that the first cut and the second cut provide alignment, and prevent rotation of, the first baffle with respect to the second baffle when the second baffle is nested within the first baffle.

Various modifications and additions can be made to the embodiments discussed without departing from the scope of the invention. For example, while the embodiments described above refer to particular features, the scope of this invention also includes embodiments having different combination of features and embodiments that do not include all of the above described features.

Specific Exemplary Embodiments

We now turn to the embodiments as illustrated by the drawings. FIGS. 1-8 illustrate some of the features of a noise suppressor that further improves the reduction of muzzle blast without increasing the size or weight of the noise suppressor, as referred to above. The apparatuses or systems illustrated by FIGS. 1-8, in some cases, may refer to examples of different embodiments that include various components, which can be considered alternatives or which can be used in conjunction with one another in the various embodiments. The description of the illustrated apparatuses or systems shown in FIGS. 1-8 is provided for purposes of illustration and should not be considered to limit the scope of the different embodiments.

Figure 2:
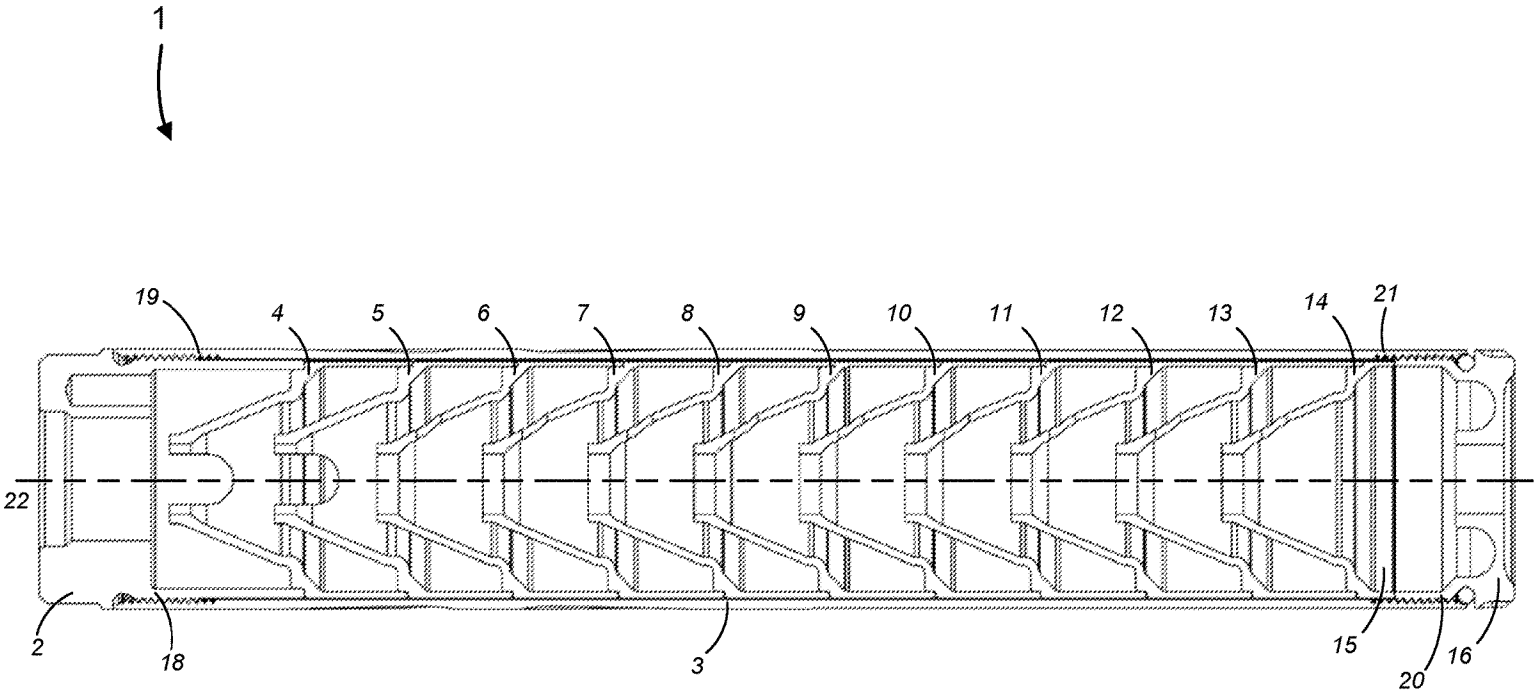
FIG. 2 shows a cross sectional side view of the noise suppressor of FIG. 1, when assembled.
Figure 3:
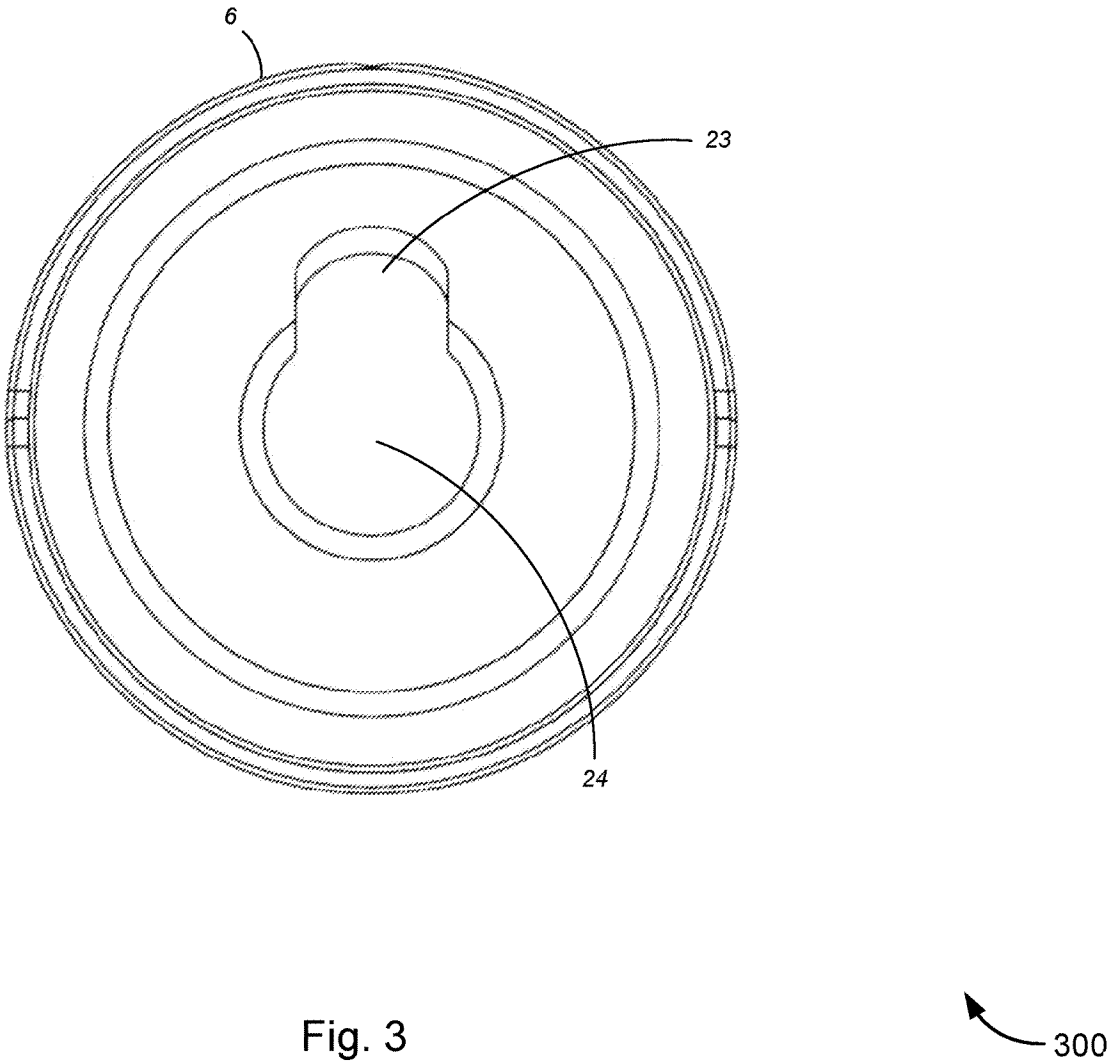
FIG. 3 shows an end view of the proximal end of baffle 6 of the noise suppressor of FIG. 1.
Figure 4:
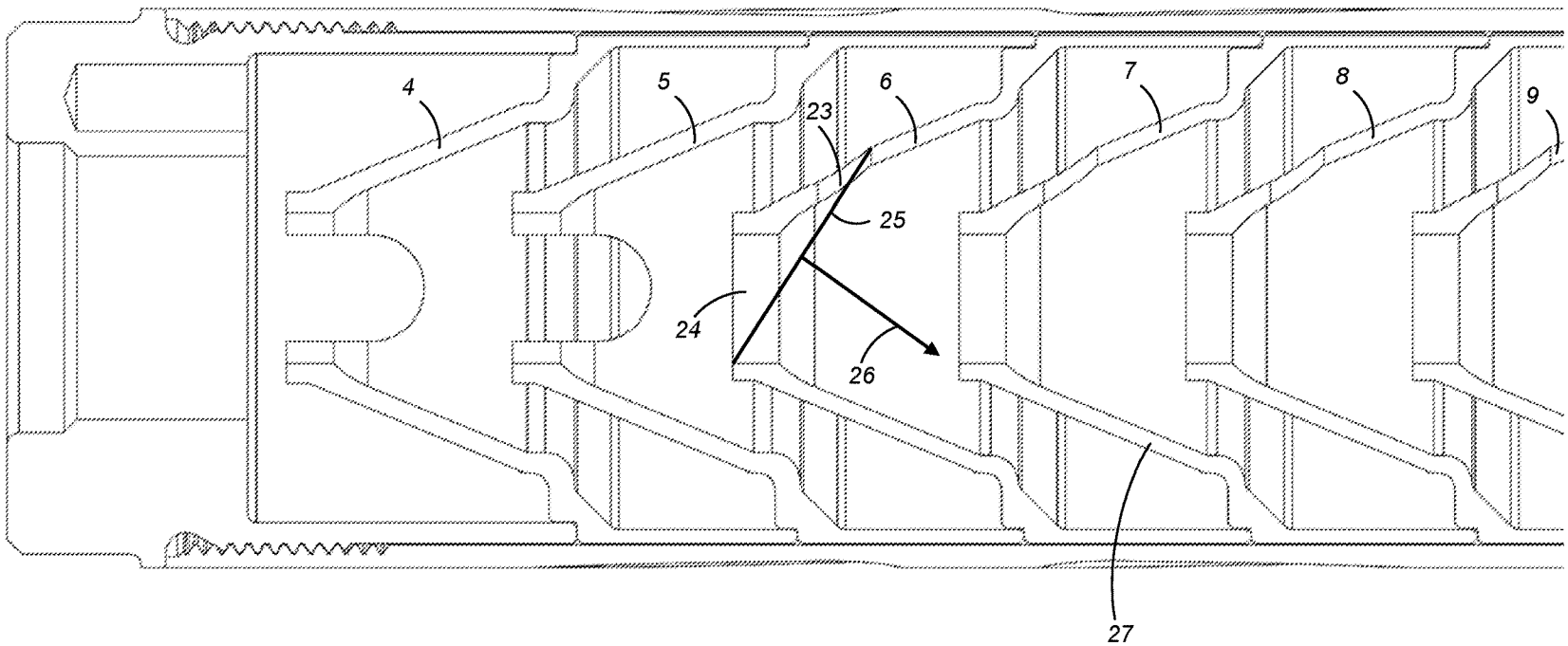
FIG. 4 shows a portion of the cross sectional side view of the noise suppressor of FIG. 2.
Figure 8:
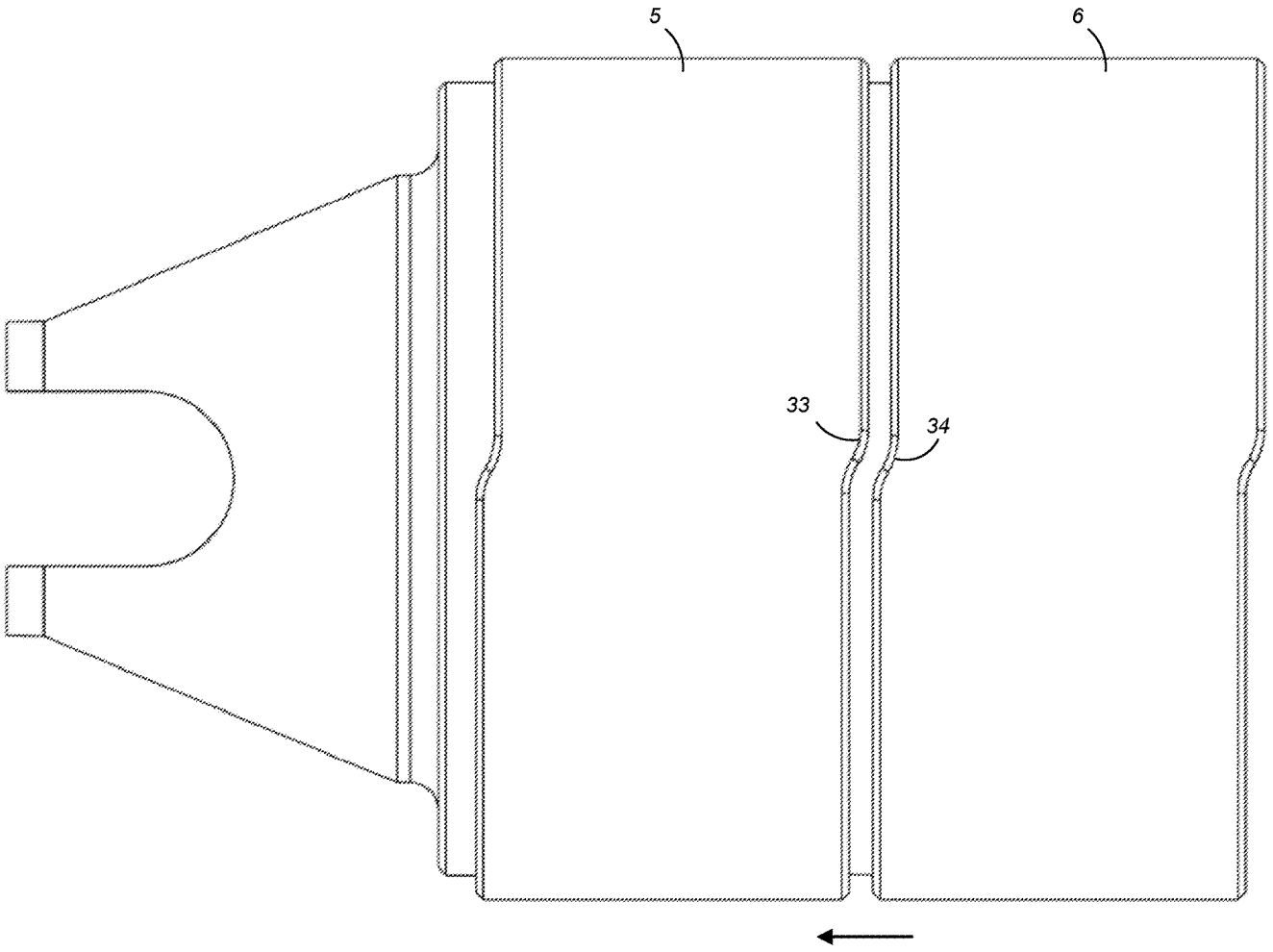
FIG. 8 shows an elevation side view of two baffles in which a first baffle is nested inside a second baffle.

With reference to FIG. 1, the noise suppressor 1 according to various embodiments of the present invention comprises a proximal end cap 2, outer tube 3, a series of nested baffles 4 through 14, an O-ring 15, and a distal end cap 16. As used in this application, the term "proximal" is used to refer to the end of the component or element closest to a barrel of a firearm and the term "distal" is used to refer to the end of the component or element farthest from the barrel of the firearm. FIG. 1 shows the various components separately as the components would be assembled. The dashed line or arrow 17 indicates the order in which the components of noise suppressor 1 are assembled whereby baffles 4 through 14 are nested inside one another as shown in FIGS. 2, 4, and 8. Baffles 4 through 14 and O-ring 15 slide within outer tube 3 and are secured within outer tube 3 by proximal end cap 2 and distal end cap 16. Specifically, a first threaded interface 18 of proximal end cap 2 attaches to a second threaded interface 19 located on the inner surface of the proximal end of outer tube 3 and third threaded interface 20 of distal end cap 16 attaches to a fourth threaded interface 21 located on the inner surface of the distal end of outer tube 3 (not explicitly shown in FIG. 1 due to the orientation of noise suppressor 1). A cross-sectional side view of noise suppressor 1 as assembled is shown in FIG. 2. As assembled, proximal end cap 2, outer tube 3, a series of baffles 4 through 14, an O-ring 15, a distal end cap 16, first threaded interface 18, second threaded interface 19, third threaded interface 20, and fourth threaded interface 21 are each oriented along a central axis 22.

In order to improve the dissipation of the high-pressure gases that enter noise suppressor 1, each baffle 6 through 14 has a notch formed in the proximal end of baffle. For example, a notch 23 located adjacent to aperture 24 is shown in baffle 6 shown in FIG. 3. The presence of notch 23 in baffle 6 allows a high pressure line 25 to form across the notch 23 and aperture 24 as shown in FIG. 4. High pressure line 25 forces a portion of the high pressure gas entering baffle 6 along a direction as shown by line or arrow 26, which cause this portion of the high pressure gas to turn around outer surface 27 of baffle 7 and further dissipate the high pressure gases. A similar effect occurs in baffles 7 through 14.

Figure 5:
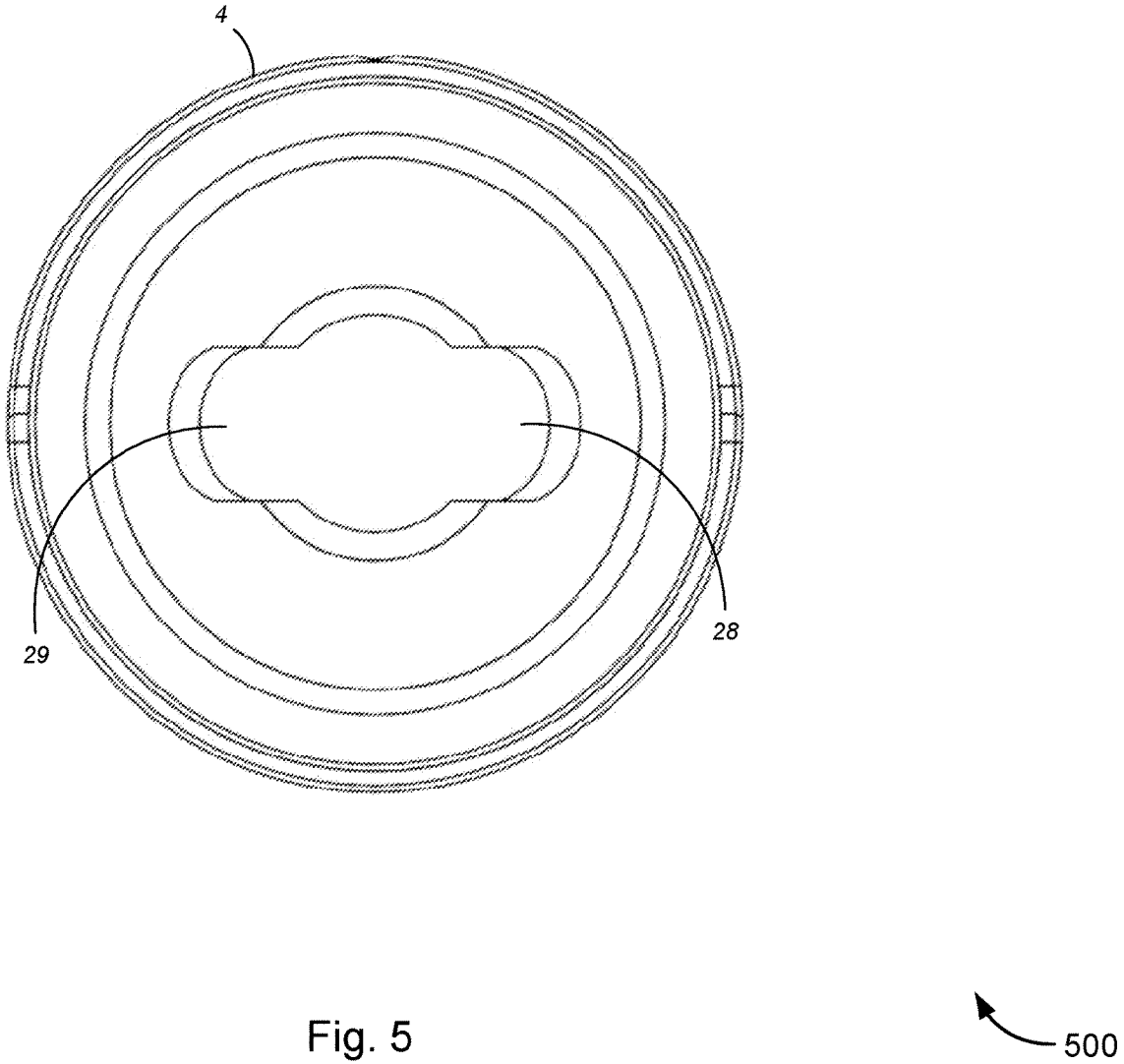
FIG. 5 shows an end view of the proximal end of baffle 4 of the noise suppressor of FIG. 1.
Figure 6:
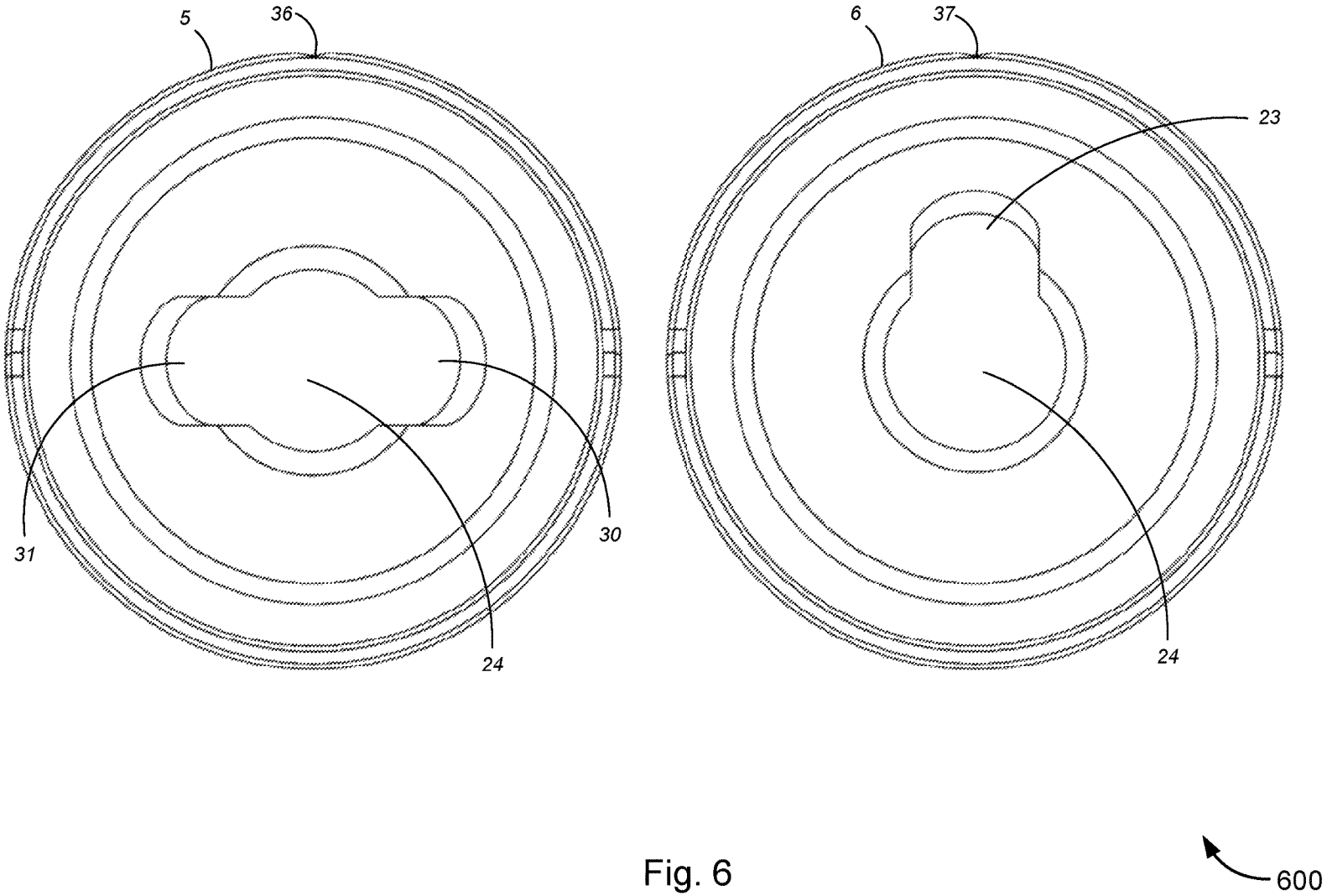
FIG. 6 shows an end view of the proximal ends of two of the baffles of the noise suppressor of FIG. 1.

In this preferred embodiment, baffle 4 has two notches 28 and 29 formed in its proximal end as shown in FIGS. 1 and 5. Similarly, baffle 5 has two notches 30 and 31 formed is its proximal end as shown in FIGS. 1 and 6. Baffles 4 and 5 are oriented within outer tube 3 such that notches 28 and 29 of baffle 4 and notches 30 and 31 of baffle 5 are oriented 90 degrees from the notches in baffles 6 through 14 as shown in FIG. 1. The orientation of notches 30 and 31 of baffle 5 and notch 22 of baffle 6 is shown in FIG. 6. As shown in FIG. 6, when the grooves 36 and 37 are aligned when baffle 6 is nested within baffle 5, the notches 30 and 31 of baffle 5 are oriented along a direction that is 90 degrees with respect to the direction in which notch 23 of baffle 6 is oriented.

Applicants have found that the presence of two notches in baffles 4 and 5, which are rotated 90 degrees with respect to the single notches in the remaining baffles 6-14, minimizes the amount of the muzzle blast from noise suppressor 1. For example, in a specific, non-limiting embodiment, a noise suppressor with double notches in the first two baffles oriented 90 degrees from (or with respect to) single notches in remaining baffles exhibited a muzzle blast of approximately 1.7 dB less than a noise suppressor where each baffle has a single notch oriented in the same direction and approximately 2.0 dB less than a noise suppressor where the first baffle has double notches that are oriented in the same direction with the single notches of the remaining baffles. In other words, the presence of double notches in the first two baffles, which are oriented 90 degrees with respect to the remaining baffles with single notches, provided the lowest dB level of the muzzle blast as shown in the chart below:

| Configuration of notches in baffles | dB Level |
|---|---|
| First two baffles with double notches and oriented 90 degrees with respect to remaining baffles with single notch | 116.3 |
| First baffle with double notches and oriented 90 degrees with respect to the remaining baffles with single notch | 117.6 |
| All baffles with single notch and oriented in the same direction | 118.0 |
| First baffle with double notches oriented in the same direction with the remaining baffles with single notch | 118.3 |
| All baffles with double notches and oriented in the same direction | 119.9 |

The decibel measurements in the above table were taken using a Bruel & Kjaer 2209 impulse precision sound level meter located 1.6 meters above the ground and one meter to the left of the muzzle of the firearm in accordance with the Department of Defense Design Criteria Standard on Noise Limits (MIL-STD-1474D).

Figure 7:
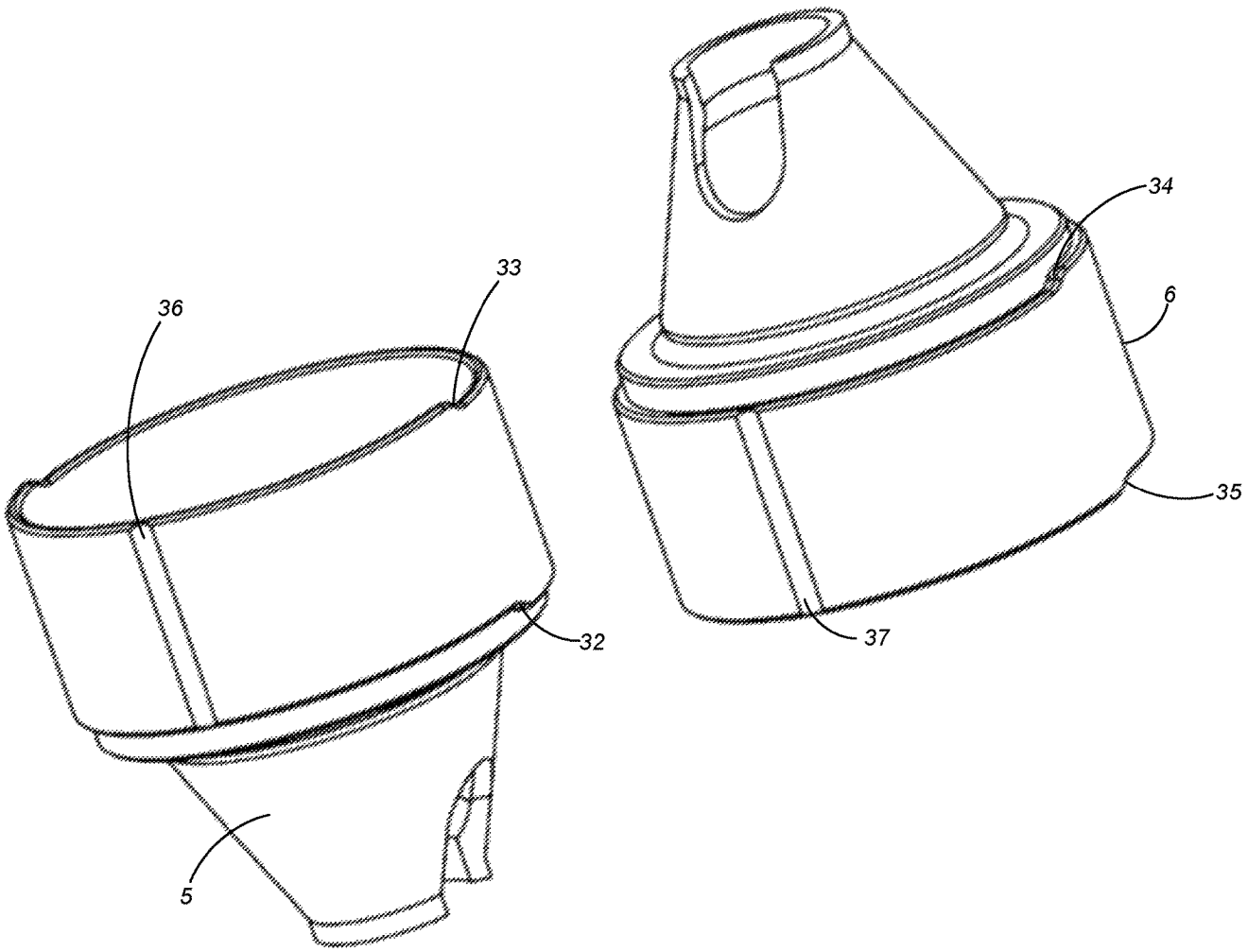
FIG. 7 shows two perspective views of two baffles of the noise suppressor of FIG. 1.

Baffles 4 through 14 of noise suppressor 1 can be removed from outer tube 3. Once removed from outer tube 3, baffles 4 through 14 can be separated from one another such that the baffles can be cleaned and otherwise maintained. In order to ensure that the user of noise suppressor 1 reassembles baffles 4 through 14 correctly, each baffle 4 through 14 have two cuts located 180 degrees around of the outer circumference of the baffle. For example, baffle 5 has circumferential cuts 32 and 33 and baffle 6 has circumferential cuts 34 and 35 as shown in FIG. 7. When nested together, cut 33 of baffle 5 and cut 34 of baffle 6 properly align as shown in FIG. 8. (In FIG. 8, baffles 5 and 6 are shown slightly separated, instead of fully nested, in order to better show cuts 33 and 34.) Each of the remaining baffles has similar, if not identical, cuts as baffles 5 and 6 shown in FIGS. 7 and 8.

In addition, as shown in FIGS. 1, 3, and 5-7, baffles 5 and 6 have cuts (or grooves) 36 and 37, respectively, on a portion of their outer surfaces and parallel to the central axis. When the user properly nests the baffles 5 and 6 to reassemble noise suppressor 1, cuts (or grooves) 36 and 37 align in series as shown in FIG. 1.

Existing baffle alignment mechanisms utilize various male/female components. However, such existing alignment mechanisms can be damaged when existing baffles are incorrectly aligned and placed within the outer tube of the suppressor. The alignment aides (e.g., cuts 32-35 or the like, cuts or grooves 36 and 37 or the like) that are disclosed in the various embodiments of this invention ensure that the user reassembles the baffles correctly to ensure the notches in the baffles are properly aligned and that the baffles cannot be damaged from incorrect reassembly.

Some embodiments include a noise suppressor comprising baffle notches and alignment mechanisms as described above and shown in the drawings. Other embodiments might provide other combinations of baffle notches and alignment mechanisms utilized in noise suppressors with greater or less than the number of baffles disclosed above and other configurations of noise suppressors, which include, without limitation, the suppressors described in the Related Applications, which are already incorporated herein by reference in their entirety for all purposes.

What is claimed is:

1. A noise suppressor for a firearm, comprising:
a central axis;
a first baffle, wherein the first baffle comprises:
a proximal end having a first aperture oriented along the central axis; and
a plurality of notches in the proximal end of the first baffle that are adjacent to the first aperture and aligned in a first orientation;
a second baffle, wherein the second baffle comprises:
a proximal end having a second aperture oriented along the central axis; and
a plurality of notches in the proximal end of the second baffle that are adjacent to the second aperture and aligned in the first orientation; and
a third baffle, wherein the third baffle comprises:
a proximal end having a third aperture oriented along the central axis; and
only a single notch in the proximal end of the third baffle that is adjacent to the third aperture and aligned in a second orientation, wherein the second orientation is different from the first orientation,
wherein the second baffle nests within the first baffle and the third baffle nests within the second baffle.

2. The noise suppressor of claim 1, wherein the second orientation is 90 degrees with respect to the first orientation.

3. The noise suppressor of claim 1, wherein:
the first baffle further comprises:
a distal end; and
a first cut disposed along a portion of the distal end of the first baffle; and
the second baffle further comprises:
a distal end; and
a second cut disposed along a portion of the second baffle between the proximal end of the second baffle and the distal end of the second baffle;
wherein the first cut aligns with and is adjacent to the second cut when the second baffle is nested within the first baffle.

4. The noise suppressor of claim 3, wherein:
the first baffle further comprises:
an outer surface of the first baffle; and
a third cut located along a portion of the outer surface of the first baffle, wherein the third cut is parallel to the central axis; and
the second baffle further comprises:
an outer surface of the second baffle; and
a fourth cut located along a portion of the outer surface of the second baffle, wherein the fourth cut is parallel to the central axis; and
wherein the third cut and fourth cut are aligned in series when the second baffle is nested within the first baffle.

5. The noise suppressor of claim 4, wherein the third cut is a groove and wherein the fourth cut is a groove.

6. The noise suppressor of claim 4, wherein the first cut is disposed along a portion of the outer surface of the first baffle at the distal end of the first baffle, wherein the second cut is disposed along a portion of a proximal end of the outer surface of the second baffle, wherein the proximal end of the outer surface of the second baffle is disposed between the proximal end of the second baffle and the distal end of the second baffle, wherein the first cut and the second cut are cuts that are complementary with each other, and wherein the first cut and the second cut provide alignment and prevent rotation of the first baffle with respect to the second baffle when the second baffle is nested within the first baffle.

7. The noise suppressor of claim 3, wherein:
the second baffle further comprises:
a fifth cut disposed along a portion of the distal end of the second baffle; and
the third baffle further comprises:
a distal end; and
a sixth cut disposed along a portion of the third baffle between the proximal end of the third baffle and the distal end of the third baffle;
wherein the fifth cut aligns with and is adjacent to the sixth cut when the third baffle is nested within the second baffle.

8. The noise suppressor of claim 7, wherein:
the first baffle further comprises:
a partial conical projection having a central axis through which the first aperture is disposed, the partial conical projection of the first baffle extending radial outward from the central axis of the partial conical projection and from the proximal end of the first baffle to a portion of the first baffle between the proximal end of the first baffle and the distal end of the first baffle, wherein the plurality of notches is formed within a side wall of the partial conical projection of the first baffle and adjacent to the first aperture;
the second baffle further comprises:
a partial conical projection having a central axis through which the second aperture is disposed, the partial conical projection of the second baffle extending radial outward from the central axis of the partial conical projection and from the proximal end of the second baffle to the portion of the second baffle between the proximal end of the second baffle and the distal end of the second baffle, wherein the plurality of notches is formed within a side wall of the partial conical projection of the second baffle and adjacent to the second aperture; and
the third baffle further comprises:
a partial conical projection having a central axis through which the third aperture is disposed, the partial conical projection of the third baffle extending radial outward from the central axis of the partial conical projection and from the proximal end of the third baffle to the portion of the third baffle between the proximal end of the third baffle and the distal end of the third baffle, wherein the single notch is formed within a side wall of the partial conical projection of the third baffle and adjacent to the third aperture.

9. A noise suppressor for a firearm, comprising:
a central axis;
a first baffle, wherein the first baffle comprises:
a proximal end having a first aperture oriented along the central axis;
two notches in the proximal end of the first baffle, wherein each notch is adjacent to the first aperture and aligned in a first orientation; and
a partial conical projection having a central axis through which the first aperture is disposed, the partial conical projection of the first baffle extending radial outward from the central axis of the partial conical projection and from the proximal end of the first baffle to a portion of the first baffle between the proximal end of the first baffle and a distal end of the first baffle, wherein the two notches are each formed within a side wall of the partial conical projection of the first baffle and adjacent to the first aperture;
a second baffle, wherein the second baffle comprises:
a proximal end having a second aperture oriented along the central axis; and
only a single notch in the proximal end of the second baffle adjacent to the second aperture and aligned in a second orientation, wherein the second orientation is different from the first orientation.

10. The noise suppressor of claim 9, wherein the two notches in the proximal end of the first baffle are arranged 180 degrees with respect to each other as viewed from along the central axis.

11. The noise suppressor of claim 9, wherein the second orientation is oriented 90 degrees with respect to the first orientation as viewed from along the central axis.

12. The noise suppressor of claim 9, further comprising:
a third baffle, wherein the third baffle comprises:
a proximal end having a third aperture oriented along the central axis; and
two notches in the proximal end of the third baffle, wherein each notch is adjacent to the third aperture and aligned in the first orientation.

13. The noise suppressor of claim 12, wherein the third baffle nests within the first baffle and the second baffle nests within the third baffle.

14. The noise suppressor of claim 12, wherein:
the second baffle further comprises:
a partial conical projection having a central axis through which the second aperture is disposed, the partial conical projection of the second baffle extending radial outward from the central axis of the partial conical projection and from the proximal end of the second baffle to a portion of the second baffle between the proximal end of the second baffle and a distal end of the second baffle, wherein the notch is formed within a side wall of the partial conical projection of the second baffle and adjacent to the second aperture; and
the third baffle further comprises:
a partial conical projection having a central axis through which the third aperture is disposed, the partial conical projection of the third baffle extending radial outward from the central axis of the partial conical projection and from the proximal end of the third baffle to a portion of the third baffle between the proximal end of the third baffle and a distal end of the third baffle, wherein the two notches are each formed within a side wall of the partial conical projection of the third baffle and adjacent to the third aperture.

15. A noise suppressor for a firearm, comprising:
a central axis;
a first baffle, wherein the first baffle comprises:
a distal end; and
a first circumferential cut disposed along a portion of the circumference of the distal end of the first baffle, such that the portion of the circumference with the first circumferential cut is offset along the central axis compared with another portion of the circumference of the first baffle without the first circumferential cut, and the portion with the first circumferential cut and the portion without the first circumferential cut are joined in a continuous circumferential loop by two angled portions; and
a second baffle, wherein the second baffle comprises:
a distal end;
a proximal end; and
a second circumferential cut disposed along a portion of the circumference of the second baffle between the proximal end of the second baffle and the distal end of the second baffle, such that the portion of the circumference with the second circumferential cut is offset along the central axis compared with another portion of the circumference of the second baffle without the second circumferential cut, and the portion with the second circumferential cut and the portion without the second circumferential cut are joined in a continuous circumferential loop by two angled portions;
wherein the second baffle nests within the first baffle; and
wherein the first circumferential cut aligns with and is adjacent to the second circumferential cut when the second baffle is nested within the first baffle.

16. The noise suppressor of claim 15, wherein:
the first baffle further comprises:
an outer surface of the first baffle; and
a third cut located along a portion of the outer surface of the first baffle, wherein the third cut is parallel to the central axis; and
the second baffle further comprises:
an outer surface of the second baffle; and
a fourth cut located along a portion of the outer surface of the second baffle, wherein the fourth cut is parallel to the central axis; and
wherein the third cut and fourth cut are aligned in series when the second baffle is nested within the first baffle.

17. The noise suppressor of claim 16, wherein the third cut is a groove and wherein the fourth cut is a groove.

18. The noise suppressor of claim 16, wherein the first cut is disposed along a portion of the outer surface of the first baffle at the distal end of the first baffle, wherein the second cut is disposed along a portion of a proximal end of the outer surface of the second baffle, wherein the proximal end of the outer surface of the second baffle is disposed between the proximal end of the second baffle and the distal end of the second baffle, wherein the first cut and the second cut are cuts that are complementary with each other, and wherein the first cut and the second cut provide alignment and prevent rotation of the first baffle with respect to the second baffle when the second baffle is nested within the first baffle.

* * * * *